US010944224B2

(12) United States Patent
Fukatsu et al.

(10) Patent No.: US 10,944,224 B2
(45) Date of Patent: Mar. 9, 2021

(54) JOINT CONNECTOR

(71) Applicant: Sumitomo Wiring Systems, Ltd., Mie (JP)

(72) Inventors: Yukihiro Fukatsu, Mie (JP); Toshikazu Sakurai, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/738,270

(22) Filed: Jan. 9, 2020

(65) Prior Publication Data

US 2020/0251865 A1 Aug. 6, 2020

(30) Foreign Application Priority Data

Jan. 31, 2019 (JP) ..... JP2019-015412

(51) Int. Cl.

| | |
|---|---|
| ***H01R 31/08*** | (2006.01) |
| ***H01R 13/10*** | (2006.01) |
| ***H01R 13/05*** | (2006.01) |
| *H01R 13/627* | (2006.01) |

(52) U.S. Cl.

CPC ..... *H01R 31/08* (2013.01); *H01R 13/05* (2013.01); *H01R 13/10* (2013.01); *H01R 13/6273* (2013.01)

(58) Field of Classification Search

CPC ..... H01R 31/08; H01R 13/05; H01R 13/10; H01R 13/6273

USPC ..... 439/345

See application file for complete search history.

(56) References Cited

U.S. PATENT DOCUMENTS

| | | | | |
|---|---|---|---|---|
| 4,946,399 | A * | 8/1990 | Kawashima | H01R 13/436 439/752 |
| 6,089,928 | A * | 7/2000 | Miwa | H01R 13/4362 439/595 |
| 6,461,203 | B2 * | 10/2002 | Todo | H01R 13/4362 439/752 |
| 7,048,582 | B2 * | 5/2006 | Tabata | H01R 13/113 439/595 |
| 9,356,412 | B2 * | 5/2016 | Kubodera | C22C 9/06 |
| 9,368,906 | B2 * | 6/2016 | Endo | H01R 13/428 |
| 9,666,956 | B2 * | 5/2017 | Takahashi | H01R 43/00 |

(Continued)

FOREIGN PATENT DOCUMENTS

| | | | | |
|---|---|---|---|---|
| JP | 2000-077145 | * | 3/2000 | H01R 31/08 |
| JP | 2000-77145 | | 3/2000 | |

*Primary Examiner* — Peter G Leigh

(74) *Attorney, Agent, or Firm* — Gerald E. Hespos; Michael J. Porco; Matthew T. Hespos

(57) ABSTRACT

A joint connector includes a plurality of target terminals (40), a joint terminal (10) connected to the respective target terminals (40) for short-circuiting the respective target terminals (40), and a housing (60) for accommodating the respective target terminals (40). The target terminal (40) includes a coupling portion (44) located between a body portion (42) and a crimping portion (43) to couple the both and having a concave cross-section. The joint terminal (10) includes a base portion (11) and a plurality of contact pieces (12) projecting from the base portion (11) and moves to an entrance position where the respective contact pieces (12) are inserted into the coupling portions (44) of the respective target terminals (40) after the respective target terminals 40 are accommodated into the housing (60). Each contact piece (42) resiliently contacts an inner surface of the corresponding coupling portion 44 at the entrance position.

4 Claims, 6 Drawing Sheets

(56) References Cited

U.S. PATENT DOCUMENTS

| | | | | |
|---|---|---|---|---|
| 9,865,966 | B2 * | 1/2018 | Matsuura | H01R 13/62911 |
| 9,922,755 | B2 * | 3/2018 | Matsui | H01R 13/4361 |
| 2002/0155757 | A1 * | 10/2002 | Yoshioka | H01R 9/034<br>439/607.01 |
| 2017/0040731 | A1 * | 2/2017 | Nishiyama | H01R 13/41 |
| 2018/0366860 | A1 * | 12/2018 | Naoi | H01R 13/111 |

* cited by examiner

JOINT CONNECTOR

BACKGROUND

Field of the Invention

The invention relates to a joint connector.

Related Art

Japanese Unexamined Patent Publication No. 2000-77145 discloses a joint connector with terminals (target terminals) to be accommodated into a case (housing). A retainer is inserted into a slit in the case and a busbar is provided in the retainer. The busbar includes tabs at positions corresponding to the respective terminals. When the retainer is mounted into the case, the tips of the tabs butt against side wall end surfaces of the corresponding terminals and the terminals are short-circuited via the busbar.

The above busbar is a rigid member that cannot be deformed resiliently. Thus, there has been a concern that the retainer cannot be mounted into the case when the tips of the respective tabs butt against the side wall end surfaces unless relative positions of the busbar, the retainer and the case are set strictly. Further, the tabs are placed to overlap on the side wall end surfaces of the terminals and protrude from the side wall end surfaces. Thus, there also has been a problem of poor space efficiency.

The invention was completed in view of the above situation and provides a joint connector with fewer restrictions on a mounted position while utilizing space effectively.

SUMMARY

The invention is directed to a joint connector with target terminals and a joint terminal connected to the target terminals so that the joint terminal short-circuits the target terminals. The joint connector also has a housing for accommodating the target terminals. Each target terminal includes a tubular body, a barrel-like crimping portion and a coupling located between the body and the crimping portion to couple the body and the crimping portion. The coupling has a concave or U-shaped cross-section. The joint terminal includes a base and contact pieces projecting from the base. The joint terminal moves to an entrance position where the contact pieces are inserted into the couplings of the target terminals after the target terminals are accommodated into the housing. Each contact piece resiliently contacts an inner surface of the corresponding coupling at the entrance position.

When the joint terminal reaches the entrance position, the contact pieces enter the couplings of the respective target terminals and resiliently contact the inner surfaces of the couplings. Thus, mounting dimensions of the contact pieces with respect to the couplings need not be set strictly and design becomes easier. Further, a dead space in the coupling is utilized effectively as an entrance area for the contact piece and space efficiency is excellent.

The joint connector may include a retainer to be mounted into the housing to lock the bodies and restrict the escape of each target terminal from the housing. The joint terminal may be provided in the retainer. According to this configuration, the retainer has both a terminal retaining function and a joining function, and a dedicated member for moving the joint terminal is unnecessary. Thus, the configuration of the joint connector can be simplified.

The coupling may have a concave cross-section formed by a base wall and two side walls projecting from the base wall. The joint terminal may move in a direction along inner surfaces of the respective side walls and moving-direction side parts of the contact pieces may resiliently contact the inner surfaces of the respective side walls. According to this configuration, a large movement stroke of the joint terminal can be set and a degree of freedom in design in the moving direction of the joint terminal can be enhanced.

The coupling may have a concave cross-section formed by a base wall and two side walls projecting from the base wall. The joint terminal may move toward an inner surface of the base wall and moving-direction front parts of the contact pieces may resiliently contact the inner surface of the base wall. According to this configuration, the contact pieces merely have to contact the inner surface of the base wall at arbitrary positions between the respective side walls. Thus, large mounting tolerances of the joint terminal can be set in a separation direction of the respective side walls.

DETAILED DESCRIPTION

Figure 1:
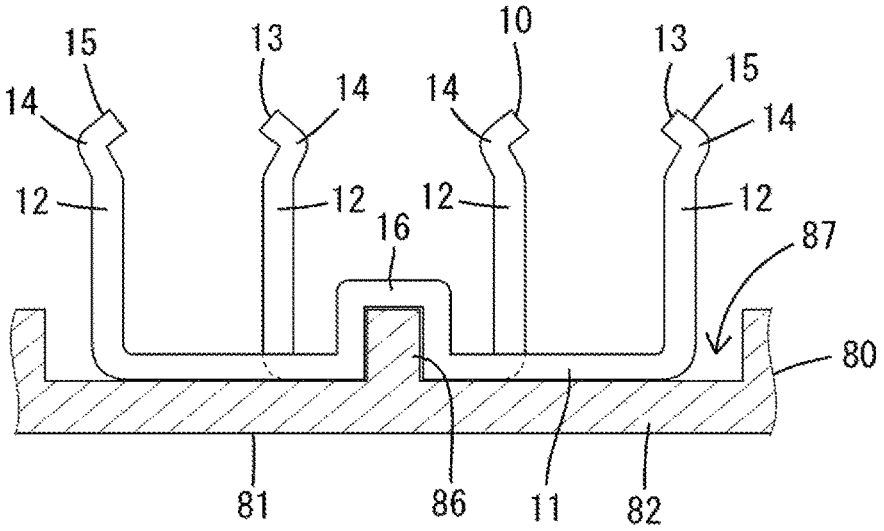
FIG. 1 is a partial front view in section of a retainer with joint terminal in a first embodiment of the present invention.

A first embodiment of the invention is described with reference to FIGS. 1 to 6. A joint connector according to the first embodiment includes a housing 60, target terminals 40 to be accommodated into the housing 60 and a joint terminal 10 connectable to each target terminal 40. The joint terminal 10 is provided in a retainer 80 to be mounted into the housing 60, and the target terminals 40 to be connected to the joint terminal 10.

Figure 2:
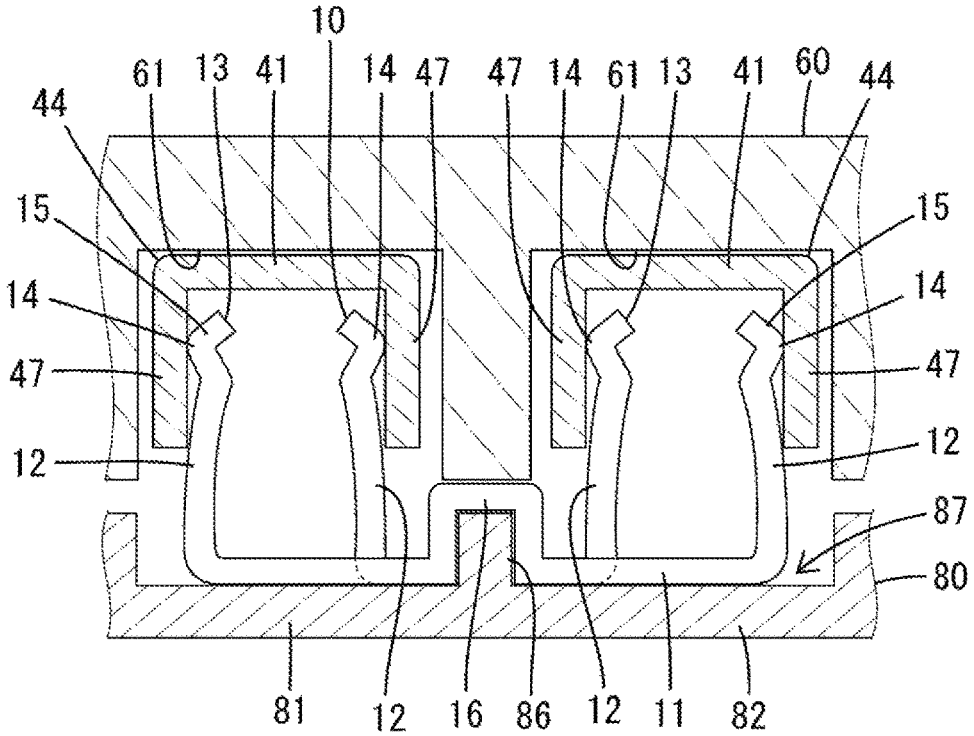
FIG. 2 is a partial front view in section showing a state where the retainer with joint terminal is mounted in a housing and each contact piece is resiliently in contact with an inner surface of each side wall of a corresponding coupling portion.
Figure 6:
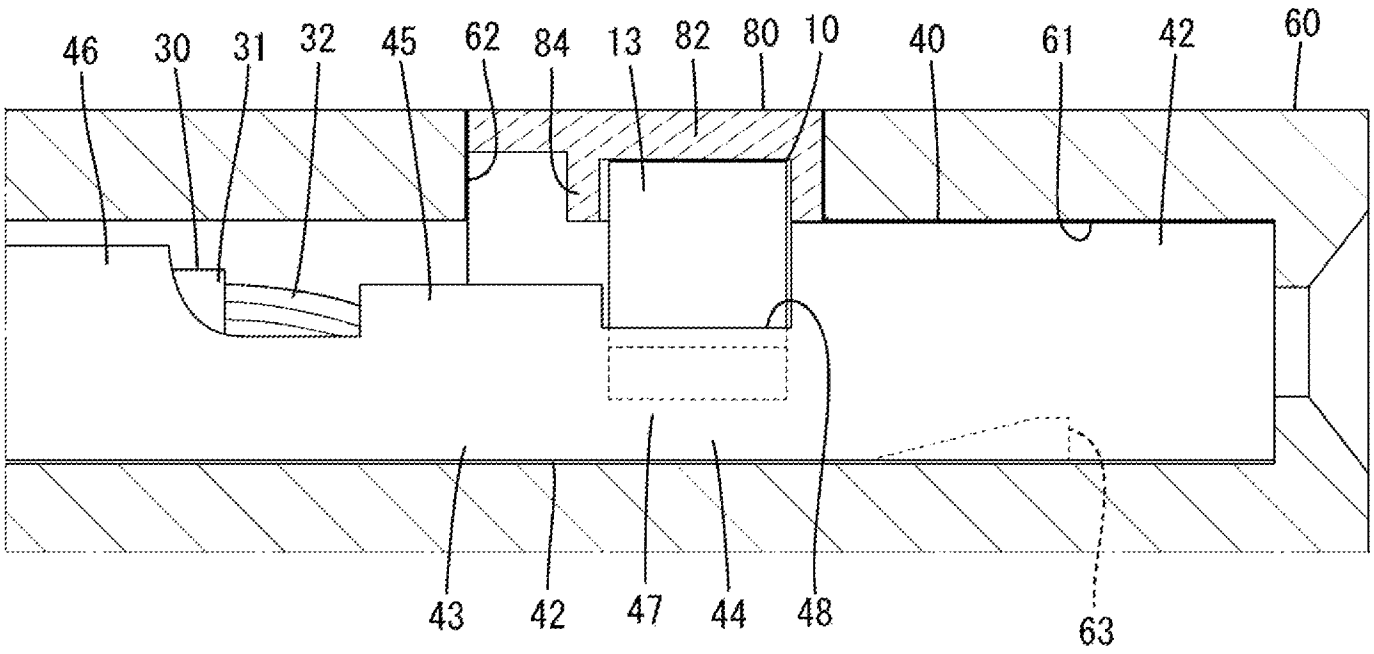
FIG. 6 is a side view in section showing a state where the retainer with joint terminal is mounted in the housing and the contact piece retains the target terminal.

The housing 60 is made of synthetic resin and includes cavities 61 arranged in a width direction, as shown in FIG. 2, and a retainer insertion hole 62 communicating with each cavity 61, as shown in FIG. 6. The housing 60 is fit to an unillustrated mating housing. Each cavity 61 penetrates the housing 60 in a front-rear direction and the corresponding target terminal 40 is inserted therein from behind. A deflectable and deformable locking lance 63 project at an inner wall of each cavity 61, and the target terminal 40 is locked by the locking lance 63. The retainer insertion hole 62 extends in a direction intersecting each cavity 61 and is open in the upper or lower surface of the housing 60. The retainer 80 is inserted into the retainer insertion hole 62.

Figure 5:
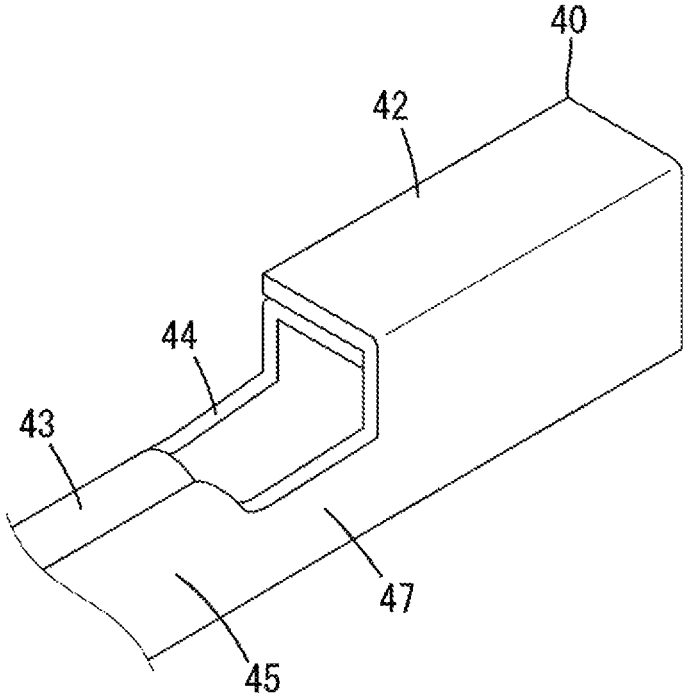
FIG. 5 is a partial perspective view of a target terminal.

The target terminal 40 is made of a conductive metal plate and has an axis extends in the front-rear direction. The target terminal 40 includes a strip-like base wall 41 extending over the entire length in the front-rear direction. This target terminal 40 is a female terminal fitting and includes a rectangular tubular body 42, a crimping portion 43 in the form of an open barrel located rearward of the body 42 and a coupling 44 coupling the body 42 and the crimping portion 43 by being located therebetween as shown in FIGS. 5 and 6.

The body 42 is assembled into a rectangular tube by bending parts protruding in the width direction from a front part of the base wall 41 in a developed state a plurality of number of times. An unillustrated resilient contact is provided in the body 42. When the housing 60 is fit to the mating housing, a tab of an unillustrated mating target terminal (male terminal fitting) accommodated in the mating housing enters the body 42 and resiliently contacts the resilient contact portion so that the target terminals are connected electrically.

As shown in FIG. 6, the crimping portion 43 is composed of a wire barrel 45 to be crimped and connected to a core 32 exposed by removing a coating 31 at an end part of a wire 30 (coated wire), and an insulation barrel 46 located rearward of the wire barrel 45 and to be crimped and connected to the coating 31 at the end part of the wire 30. Projecting parts of the wire barrel 45 and the insulation barrel 46 rising from both widthwise sides of the base wall 41 are wound around the core part 32 and the coating 31 in a crimping step.

As shown in FIG. 2, the coupling 44 has a concave cross-section and includes an intermediate part of the base wall 41 in the front-rear direction arranged along the width direction and two side walls 47 rising substantially perpendicularly from both widthwise sides of the base wall 41. The side walls 47 have front ends integrally connected to respective sides of the body 42 and rear ends integrally connected to the projecting parts of the wire barrel 45. As shown in FIG. 6, the tip of the side wall 47 in a rising direction is arranged substantially along the front-rear direction and constitutes a bottom side of a stepped recess 48 formed between the body 42 and the wire barrel 45 in a side view.

The coupling 44 is open toward the joint terminal 10 at a position corresponding to the retainer insertion hole 62 at the time of assembling, and a later-described joint portion 13 of the joint terminal 10 is inserted therein.

The retainer 80 includes a retainer body 81 made of synthetic resin. The retainer body 81 includes, as shown in FIG. 3, a plate-like mounting portion 82 extending in the width direction, and two plate-like locks 83 rising from widthwise sides of the mounting portion 82.

The mounting portion 82 has a width extending over the entire width of the housing 60 and covers an opening in the upper or lower surface of the housing 60, as shown in FIG. 6, when the retainer 80 is inserted into the retainer insertion hole 62. The mounting portion 82 includes a ladder-like rib frame 84 on an inner surface facing the retainer insertion hole 62, as shown in FIG. 3. The rib frame 84 includes two trunks 85 extending in parallel to the width direction and beams 86 arranged at intervals in the width direction between the trunks 85. The trunks 85 and the beams 86 have rectangular cross-sections. Inner spaces defined by the trunks 85 and the beams 86 in the rib frame 84 serve as mounting spaces into which the joint terminal 10 is fit over the corresponding beam 86.

Figure 3:
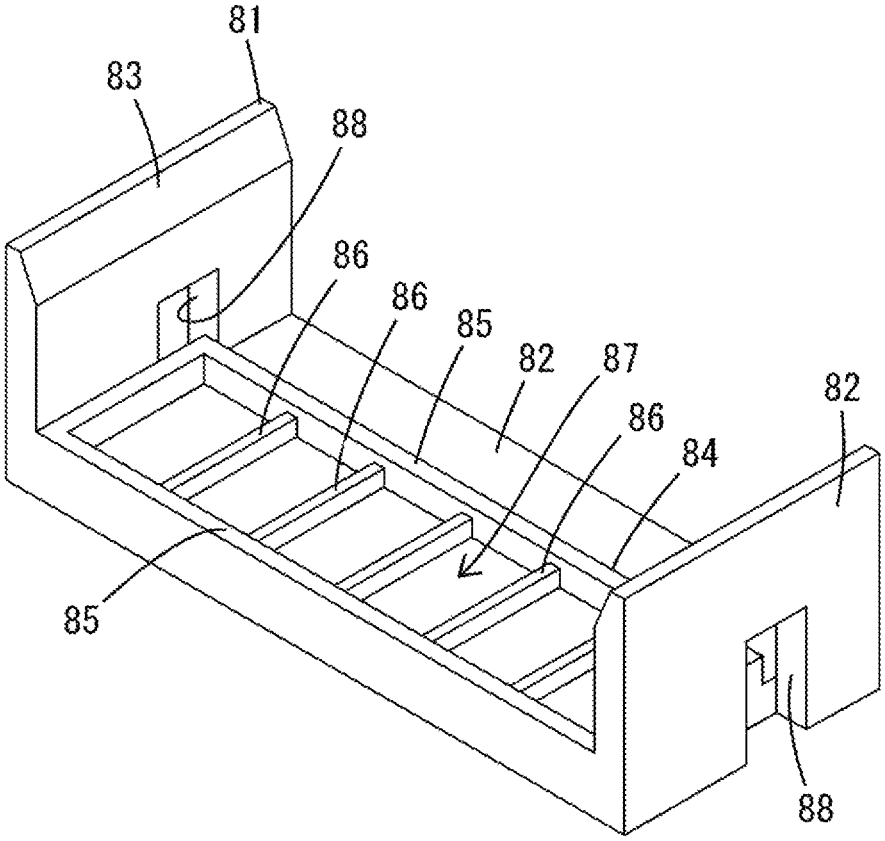
FIG. 3 is a perspective view of a retainer body portion.

As shown in FIG. 3, each lock 83 includes a lock hole 88 and is deflectable and deformable in the width direction with a coupled position to the mounting portion 82 as a fulcrum. If the retainer 80 is inserted to a proper depth into the retainer insertion hole 62, unillustrated lock projections on both widthwise surfaces of the housing 60 are fit resiliently into the lock holes 88 of the respective locks 83, and the retainer 80 is held in the housing 60.

Figure 4:
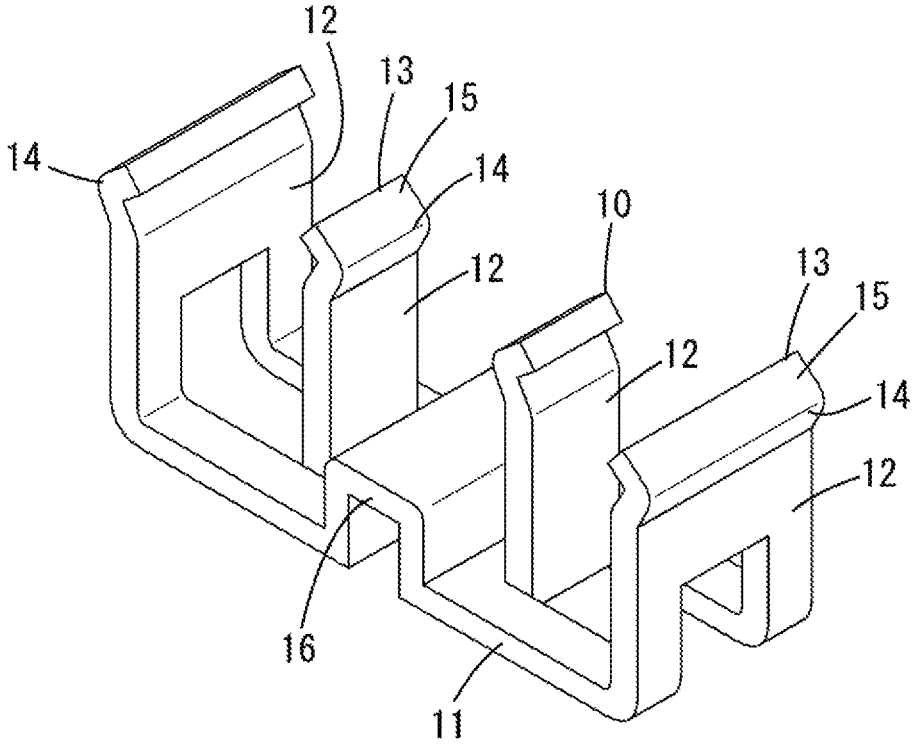
FIG. 4 is a perspective view of a joint terminal.

The joint terminal 60 is made of a conductive metal and includes, as shown in FIG. 4, a base 11 extending in the width direction and contact pieces 12 rising substantially perpendicularly from both widthwise ends and widthwise intermediate parts of the base 11. The contact pieces 12 rising from the widthwise intermediate parts of the base 11 are formed by raising parts inside cutouts formed in the base 11. Two of the contact pieces 12 on each of both widthwise sides are configured as one set. The joint terminal 10 includes two sets of joints 13 in the width direction. Each joint 13 has a concave cross-section corresponding to the coupling 44 and is composed of the base 11 (particularly widthwise side part of the base 11) arranged along the width direction and the contact pieces 12 facing in the width direction. Each joint 13 enters the coupling 44 of the corresponding target terminal 40 and includes contacts 14 projecting opposite to each other on tips of the respective contact pieces 12 in a rising direction. The contact 14 of each contact piece 12 is bent into a curved projection and has a tapered slope 15 inclined inwardly on the tip.

As shown in FIG. 4, the base 11 includes a fitting 16 bent to have a U-shaped cross-section on a rising side of each contact piece 12 at a position between the respective joints 13 in a widthwise intermediate part. The fitting 16 is fittable to the corresponding beam 86 of the retainer 80.

In the case of the first embodiment, the joint terminal 10 is composed of two sets of the joints 13 and each joint 13 functions to short-circuit the connected target terminals 40 to each other. Of course, the joint terminal 10 can include three or more sets of the joints 13, an interval between the respective sets of the joints 13 can be adjusted according to a joint circuit and a change of a joint pattern can be flexibly coped with.

Next, functions and effects of the joint connector of the first embodiment are described.

First, the joint terminal 10 is assembled with the retainer body 81. The joint terminal 10 is mounted into the mounting spaces 87 corresponding to the respective target terminals 40 in the retainer body 81 according to the joint circuit. Specifically, the base 11 of the joint terminal 10 is placed on the inner surface of the mounting portion 82 of the retainer body 81, the beam 86 of the mounting portion 82 is fit into the fitting portion 16 of the base 11 and the joint terminal 10 is held in the retainer body 81.

The target terminals 40 are inserted into the respective cavities 61 of the housing 60. In the first embodiment, the target terminals 40 are inserted into two of the cavities 61 adjacent in the width direction. The respective target terminals 40 primarily are retained in the cavities 61 by the locking lances 63. Subsequently, the retainer 80 is inserted to a proper depth into the retainer insertion hole 62 of the housing 60. Then, the retainer 80 reaches an entrance position where the joints 13 of the joint terminal 10 enter the couplings 44 of the corresponding target terminals 40 and, at the entrance position, the respective locks 83 lock the respective lock projections and are held in a movement restricted state with respect to the housing 60. At this time, the front end of the joint terminal 10 faces the rear ends of the bodies 42 and the target terminals 40 are retained secondarily in the cavities 61 (see FIG. 6).

In the above process of moving the retainer 80 to the entrance position, the slopes 15 of the contact portions 14 on the contact pieces 12 of the respective joints 13 slide on the tips of the side walls 47 of the facing coupling portions 44 and the respective contact pieces 12 are deflected and deformed inward with coupled positions to the base 11 as fulcrums. As the retainer 80 further enters, top parts of the contacts 14 of the respective contact pieces 12 slide on the inner surfaces of the side walls 47. When the retainer 80 is at the entrance position, the top parts of the contacts 14 of the respective contact pieces 12 are inserted deeply to positions near the base walls 41 on the inner surfaces of the side walls 47 and the respective contact pieces 12 contact the inner surfaces of the side walls 47 with resilient forces while being deflected and deformed (see FIG. 2). Thereafter, the target terminals 40 are connected to the mating target terminals and the joint circuit is configured by the wires connected to these target terminals.

The contact pieces 12 of the joint terminal 10 enter the couplings 44 of the corresponding target terminals 40 and contact the inner surfaces of the couplings 44 in the first embodiment. Thus, dead spaces in the couplings 44 are utilized effectively as areas for realizing the entrance and connection of the respective contact pieces 12. Particularly, since the respective contact pieces 12 are not exposed to the outside of the target terminals 40, unnecessary interference of the respective contact pieces 12 with the housing 60 and the target terminals 40 can be avoided and the connection reliability of the respective contact pieces 12 and the couplings 44 can be improved. Further, mounting tolerances of the retainer 80 into the housing 60 can be absorbed by the deflection and deformation of the respective contact pieces 12.

Further, the joint terminal 10 is provided in the retainer 80. Thus, a dedicated member for moving the joint terminal 10 is unnecessary and the connector is simplified.

The joint terminal 10 moves in a direction along the inner surfaces of the respective side walls 47 and the contacts 14 provided on the side surfaces of the respective contact pieces 12, which are side parts in a moving direction of the joint terminal 10 (also a moving direction of the retainer 80), contact the inner surfaces of the respective side walls 47. Thus, a movement stroke until the joint terminal 10 reaches the entrance can be large and a degree of freedom in design in the moving direction of the joint terminal 10 is enhanced.

Second Embodiment

Figure 7:
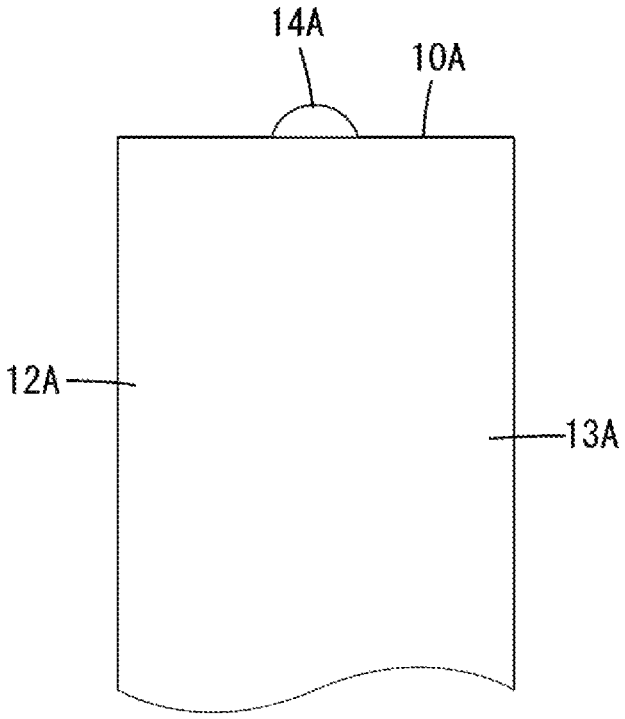
FIG. 7 is a partial side view of a contact piece of a joint terminal in a second embodiment of the present invention.
Figure 8:
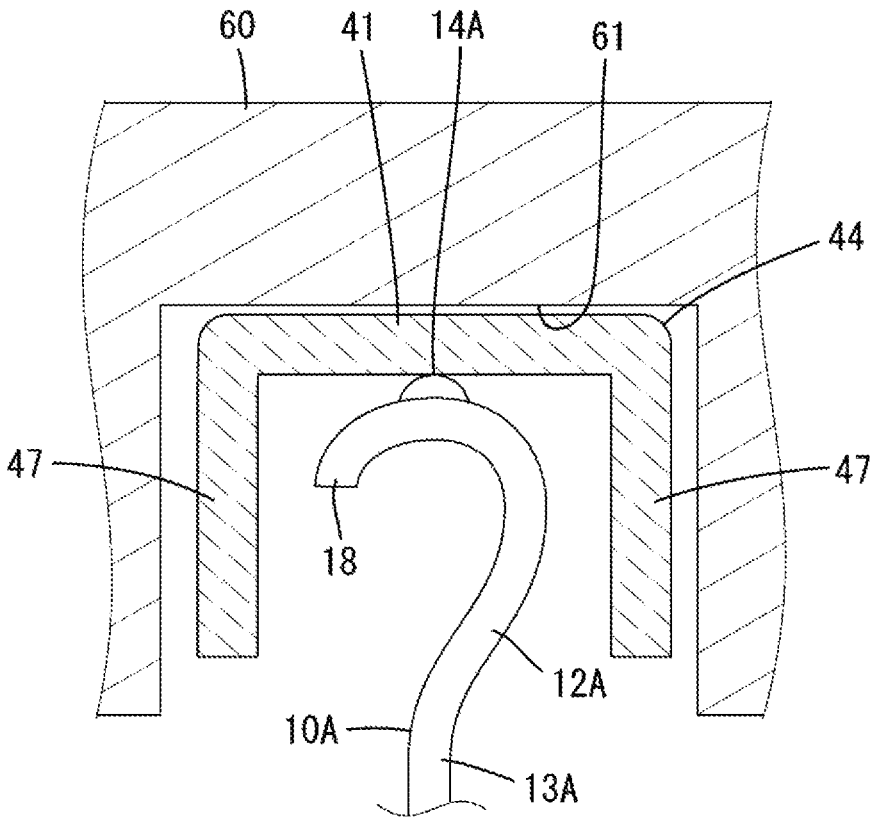
FIG. 8 is a partial front view in section showing a state where the contact piece of the joint terminal is resiliently in contact with an inner surface of a base wall portion of a coupling portion.

FIGS. 7 and 8 show a second embodiment of the invention. The second embodiment differs from the first embodiment in the configuration of joints 13A of a joint terminal 10A. Since the other configuration is the same as in the first embodiment, the same or equivalent structural elements as those of the first embodiment are denoted by the same reference signs and repeated description is omitted.

The joint terminal 10A includes joints 13A on both widthwise sides of an unillustrated base 11 (not denoted by the reference sign since being similar to that of the first embodiment) and two contact pieces 12A (only one is shown) projecting opposite to each other. That is, each joint 13A includes only one contact piece 12A. The contact piece 12A is in the form of a strip, extends in the vertical direction with plate surfaces facing forward and rearward (see FIG. 7) and includes a contact end portion 18 curved inwardly in a plate thickness direction into a hook shape on a tip distant from the base 11 (see FIG. 8). A contact 14A in the form of a semispherical projection bulges on the tip of the contact end portion 18.

When the joint terminal 10A is assembled with a retainer body 81 and a retainer 80 reaches an entrance position where the retainer 80 is mounted properly in a housing 60, the contact piece 12A of each joint 13A contacts a facing inner surface of a base wall 41 of a coupling 44 with the contact end portion 18 deflected and deformed. Thus, also in the second embodiment, a dead space in the coupling 44 of the target terminal 40 is used effectively as an area for realizing the entrance and connection of the contact piece 12A of the joint terminal 10A, as in the first embodiment.

Further, since the contact portion 14A of the contact end portion 18 of the contact piece 12A contacts the inner surface of the base wall 41 facing in a moving direction of the joint terminal 10A and a contact position of the base wall 41 and the contact portion 14A can be set arbitrarily between the respective side walls 47 in the case of the second embodiment, large mounting tolerances of the joint terminal 10A can be set in a separation direction between the respective side walls 47. Further, large mounting tolerances can be set in the moving direction of the joint terminal 10A by the deflection and deformation of the contact piece 12A.

Other embodiments are briefly described below.

The joint terminal may be provided with three or more sets of joint portions according to a joint circuit.

Plural joint terminals may be mounted in mounting spaces of one retainer body portion according to a joint circuit.

The joint terminal may be integrally held in the retainer body by insert molding. Further, the joint terminal may be integrally held in the retainer body portion via a joining means such as an adhesive material.

The target terminal may be a male terminal fitting including a male tab projecting forward from a body.

The coupling may have a U-shaped cross-section. In this case, the contact pieces of the joint terminal may contact an inner surface of a U-shaped bottom of the coupling.

The retainer may be held at a partial locking position with respect to the housing before the target terminals are inserted into the housing, and may be moved to a full locking position after the target terminals are inserted into the housing.

The joint terminal may be configured to singly move without the retainer and enter the couplings of the respective target terminals.

The joint terminal may be configured to move via a dedicated operating member that is not the retainer, and enter the couplings of the respective target terminals.

In the joint terminal of the first embodiment, the contact pieces rising from the widthwise intermediate parts of the base may be omitted. In this case, the joint portion includes only one contact piece.

LIST OF REFERENCE SIGNS

10, 10A . . . joint terminal
11 base portion
12, 12A . . . contact piece
13, 13A . . . joint portion
30 wire
40 target terminal
41 base wall
42 body
43 crimping portion
44 coupling
47 side wall
60 housing
61 cavity
80 retainer
81 retainer body

What is claimed is:

1. A joint connector, comprising:

target terminals;

a joint terminal connected to the respective target terminals, the joint terminal short-circuiting the respective target terminals;

a housing for accommodating the respective target terminals, wherein:

each target terminal includes a tubular body, a barrel-like crimping portion and a coupling located between the body and the crimping portion to couple the body and the crimping portion and having a concave or U-shaped cross-section, the joint terminal includes a base and a plurality of contact pieces projecting from the base and moves to an entrance position where the respective contact pieces are inserted into the couplings of the respective target terminals after the respective target terminals are accommodated into the housing, each contact piece resiliently contacts an inner surface of the corresponding coupling at the entrance position, and the coupling has a concave cross-section defined by a base wall and a pair of side walls projecting from the base wall, and the joint terminal moves in a direction along inner surfaces of the respective side walls and moving-direction side parts of the contact pieces resiliently contact the inner surfaces of the respective side walls.

2. The joint connector of claim 1, comprising a retainer to be mounted into the housing to lock the bodies and restrict escape of each target terminal from the housing, wherein the joint terminal is provided in the retainer.

3. A joint connector comprising:

target terminals;

a joint terminal connected to the respective target terminals, the joint terminal short-circuiting the respective target terminals;

a housing for accommodating the respective target terminals, wherein:

each target terminal includes a tubular body, a barrel-like crimping portion and a coupling located between the body and the crimping portion to couple the body and the crimping portion and having a concave or U-shaped cross-section, the joint terminal includes a base and a plurality of contact pieces projecting from the base and moves to an entrance position where the respective contact pieces are inserted into the couplings of the respective target terminals after the respective target terminals are accommodated into the housing, and each contact piece resiliently contacts an inner surface of the corresponding coupling at the entrance position, and the coupling has a concave cross-section defined by a base wall and two side walls projecting from the base wall, the joint terminal moves toward an inner surface of the base wall and moving-direction front parts of the contact pieces resiliently contact the inner surface of the base wall.

4. The joint connector of claim 3, comprising a retainer to be mounted into the housing to lock the bodies and restrict escape of each target terminal from the housing, wherein the joint terminal is provided in the retainer.

* * * * *